US009970080B2

(12) United States Patent
Curran et al.

(10) Patent No.: US 9,970,080 B2
(45) Date of Patent: May 15, 2018

(54) MICRO-ALLOYING TO MITIGATE THE SLIGHT DISCOLORATION RESULTING FROM ENTRAINED METAL IN ANODIZED ALUMINUM SURFACE FINISHES

(71) Applicant: Apple Inc., Cupertino, CA (US)

(72) Inventors: James A. Curran, Morgan Hill, CA (US); William A. Counts, Sunnyvale, CA (US); Abhijeet Misra, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 168 days.

(21) Appl. No.: 14/927,225

(22) Filed: Oct. 29, 2015

(65) Prior Publication Data

US 2017/0088917 A1 Mar. 30, 2017

Related U.S. Application Data

(60) Provisional application No. 62/232,124, filed on Sep. 24, 2015.

(51) Int. Cl.
*B32B 9/00* (2006.01)
*F01C 21/00* (2006.01)
(Continued)

(52) U.S. Cl.
CPC ..... *C22C 1/06* (2013.01); *C22C 21/10* (2013.01); *C25D 11/06* (2013.01); *C25D 11/14* (2013.01); *C25D 11/16* (2013.01); *C25D 11/243* (2013.01)

(58) Field of Classification Search
CPC ..... C22C 1/06; C22C 21/10; C25D 11/16; C25D 11/06
(Continued)

(56) References Cited

U.S. PATENT DOCUMENTS 2,692,851 A 10/1954 Burrows
3,388,050 A 6/1968 Wainer et al.
(Continued)

FOREIGN PATENT DOCUMENTS

CH 691064 A5 4/2001
CN 1254028 A 5/2000
(Continued)

OTHER PUBLICATIONS

PCT Application No. PCT/US2014/053595—International Search Report & Written Opinion dated Jun. 24, 2015.
(Continued)

*Primary Examiner* — William Cheung
(74) *Attorney, Agent, or Firm* — Dickinson Wright RLLP

(57) ABSTRACT

Micro additions of certain elements such as zirconium or titanium are added to high strength aluminum alloys to counter discoloring effects of other micro-alloying elements when the high strength alloys are anodized. The other micro-alloying elements are added to increase the adhesion of an anodic film to the aluminum alloy substrate. However, these micro-alloying elements can also cause slight discoloration, such as a yellowing, of the anodic film. Such micro-alloying elements that can cause discoloration can include copper, manganese, iron and silver. The micro additions of additional elements, such as one or more of zirconium, tantalum, molybdenum, hafnium, tungsten, vanadium, niobium and tantalum, can dilute the discoloration of the micro-alloying elements. The resulting anodic films are substantially colorless.

20 Claims, 7 Drawing Sheets

(51) Int. Cl.

| | |
|---|---|
| ***B21B 1/46*** | (2006.01) |
| ***C22C 1/06*** | (2006.01) |
| ***C22C 21/10*** | (2006.01) |
| ***C25D 11/06*** | (2006.01) |
| ***C25D 11/16*** | (2006.01) |
| ***C25D 11/14*** | (2006.01) |
| ***C25D 11/24*** | (2006.01) |

(58) Field of Classification Search
USPC ..... 428/472; 430/58.08; 418/178; 29/527.2
See application file for complete search history.

(56) References Cited

U.S. PATENT DOCUMENTS

| | | | |
|---|---|---|---|
| 3,411,994 | A | 11/1968 | Wainer et al. |
| 3,985,629 | A | 10/1976 | Kimura |
| 4,039,355 | A | 8/1977 | Takahashi et al. |
| 4,066,516 | A | 1/1978 | Sato |
| 4,483,751 | A | 11/1984 | Murayama et al. |
| 4,518,468 | A | 5/1985 | Fotland et al. |
| 4,606,796 | A | 8/1986 | Hanazima et al. |
| 4,631,112 | A | 12/1986 | Usui et al. |
| 4,856,326 | A | 8/1989 | Tsukamoto et al. |
| 4,894,127 | A | 1/1990 | Wong et al. |
| 4,987,766 | A | 1/1991 | Brar et al. |
| 5,066,368 | A | 11/1991 | Pasqualoni et al. |
| 5,078,845 | A | 1/1992 | Kunugihara et al. |
| 5,277,788 | A | 1/1994 | Nitowski et al. |
| 5,336,341 | A | 8/1994 | Maejima et al. |
| 5,472,788 | A | 12/1995 | Benitez-Garriga |
| 5,705,225 | A | 1/1998 | Dornfest et al. |
| 5,919,561 | A | 7/1999 | Fuchs et al. |
| 6,027,629 | A | 2/2000 | Hisamoto et al. |
| 6,235,409 | B1 | 5/2001 | Serafin et al. |
| 6,339,958 | B1 | 1/2002 | Tsui et al. |
| 6,581,446 | B1 | 6/2003 | Deneuville et al. |
| 7,527,872 | B2 | 5/2009 | Steele et al. |
| 7,732,056 | B2 | 6/2010 | Bhatnagar et al. |
| 8,016,948 | B2 | 9/2011 | Wang et al. |
| 8,309,237 | B2 | 11/2012 | Levendusky et al. |
| 8,535,505 | B2 | 9/2013 | Yi et al. |
| 8,691,403 | B2 | 4/2014 | Amakusa et al. |
| 8,950,465 | B2 | 2/2015 | Lin et al. |
| 8,962,163 | B2 | 2/2015 | Shimao et al. |
| 8,968,548 | B2 | 3/2015 | Lai et al. |
| 9,312,511 | B2 | 4/2016 | Mandlik et al. |
| 9,349,536 | B2 | 5/2016 | Lee et al. |
| 9,359,686 | B1 | 6/2016 | Curran et al. |
| 9,512,510 | B2 | 12/2016 | Hatta |
| 9,669,604 | B2 | 6/2017 | Tatsumi et al. |
| 2003/0196907 | A1 | 10/2003 | Viola |
| 2004/0004003 | A1 | 1/2004 | Hesse |
| 2005/0061680 | A1 | 3/2005 | Dolan |
| 2005/0106403 | A1 | 5/2005 | Yui |
| 2006/0019035 | A1 | 1/2006 | Munz et al. |
| 2006/0086475 | A1 | 4/2006 | Miyashita et al. |
| 2008/0274375 | A1 | 11/2008 | Ng et al. |
| 2008/0283408 | A1 | 11/2008 | Nishizawa |
| 2009/0050485 | A1 | 2/2009 | Wada et al. |
| 2009/0152120 | A1 | 6/2009 | Cao et al. |
| 2009/0233113 | A1 | 9/2009 | Hisamoto et al. |
| 2010/0024534 | A1 | 2/2010 | Li et al. |
| 2010/0264036 | A1 | 10/2010 | Hatanaka et al. |
| 2010/0326839 | A1 | 12/2010 | Morikawa et al. |
| 2011/0252874 | A1 | 10/2011 | Patten et al. |
| 2011/0297319 | A1 | 12/2011 | Chen et al. |
| 2012/0000783 | A1* | 1/2012 | Suda ..... C25D 11/04 205/50 |
| 2012/0103819 | A1 | 5/2012 | Chang et al. |
| 2012/0298513 | A1 | 11/2012 | Shimao et al. |
| 2013/0008796 | A1 | 1/2013 | Silverman et al. |
| 2013/0075262 | A1 | 3/2013 | Teng |
| 2013/0153427 | A1 | 6/2013 | Tatebe |
| 2013/0156635 | A1 | 6/2013 | Lee et al. |
| 2013/0302641 | A1 | 11/2013 | Zhang et al. |
| 2013/0319868 | A1 | 12/2013 | Yoshida et al. |
| 2013/0319872 | A1 | 12/2013 | Woodhull et al. |
| 2014/0061054 | A1 | 3/2014 | Ye |
| 2014/0083861 | A1 | 3/2014 | Askin et al. |
| 2014/0262790 | A1 | 9/2014 | Levendusky et al. |
| 2015/0132541 | A1 | 5/2015 | McDonald et al. |
| 2016/0060783 | A1 | 3/2016 | Curran et al. |
| 2016/0237586 | A1 | 8/2016 | Curran et al. |
| 2016/0289858 | A1 | 10/2016 | Curran et al. |
| 2016/0290917 | A1 | 10/2016 | Hamann et al. |
| 2017/0051425 | A1 | 2/2017 | Curran et al. |
| 2017/0051426 | A1 | 2/2017 | Curran et al. |
| 2017/0292202 | A1 | 10/2017 | Curran et al. |
| 2018/0049337 | A1 | 2/2018 | Curran et al. |

FOREIGN PATENT DOCUMENTS

| | | | |
|---|---|---|---|
| CN | 1616709 | A | 5/2005 |
| CN | 1774158 | A | 5/2006 |
| CN | 1965618 | A | 5/2007 |
| CN | 101287861 | A | 10/2008 |
| CN | 101298690 | A | 11/2008 |
| CN | 101325849 | A | 12/2008 |
| CN | 102333897 | A | 1/2012 |
| CN | 102654782 | A | 9/2012 |
| CN | 102666894 | A | 9/2012 |
| CN | 103484737 | A | 1/2014 |
| CN | 103484916 | A | 1/2014 |
| CN | 103526088 | A | 1/2014 |
| CN | 103732772 | A | 4/2014 |
| CN | 104762538 | A | 7/2015 |
| EP | 997545 | A1 | 5/2000 |
| EP | 1688020 | B1 | 8/2006 |
| EP | 1397244 | B1 | 12/2009 |
| EP | 2301760 | A2 | 3/2011 |
| EP | 2817948 | A1 | 12/2014 |
| JP | H0347937 | A | 2/1991 |
| JP | 2000313996 | | 11/2000 |
| JP | 2009209426 | A | 9/2009 |
| KR | 1020120021616 | | 3/2012 |
| KR | 101235350 | B1 | 2/2013 |
| WO | 2010099258 | A1 | 9/2010 |
| WO | 2013123770 | A1 | 8/2013 |
| WO | 2014045886 | A1 | 3/2014 |
| WO | 2014149194 | A1 | 9/2014 |
| WO | 2015199639 | A1 | 12/2015 |

OTHER PUBLICATIONS

Habazaki et al., "Nanoscale Enrichments of Substrate Elements in the Growth of Thin Oxide Films", Corrosion Science, vol. 39, No. 4, pp. 731-737, 1997.

Vesborg et al., "Addressing the terawatt challenge: scalability in the supply of chemical elements for renewable energy," RSC Advances, 2, pp. 7933-7947, 2012.

U.S. Appl. No. 14/474,021—Non Final Office Action dated Aug. 27, 2015.

PCT Application No. PCT/US2015/010736—International Search Report & Written Opinion dated Nov. 29, 2015.

PCT Application No. PCT/US2015/024349—International Search Report & Written Opinion dated Dec. 17, 2015.

PCT Application No. PCT/U52015/025000—International Search Report and Written Opinion dated Jan. 26, 2016.

Garcia-Vergara, S. et al; "Morphology of enriched alloy layers in an anodized Al—Cu alloy" Applied Surface Science, 205 (2003),p. 121-127.

Alwitt, R.S. and R.C. McClung , "Mechanical Properties of Anodized Aluminum Coatings"; Proceedings of the SUR/FIN7 '92, American Electroplaters and Surface Finishers Society, Atlanta, Georgia, Jun. 1992.

Yann Goueffon et al., "Study of Degradation Mechanisms of Black Anodic Films in Simulated Space Environment" URL: http://webcache.googleusercontent.com/search?q=cache:fsJq5LjVTVIJ:esmat.esa.int/materials_news/isme09/pdf/6-Contamination/S8%2520-%2520Goueffon.pdf+&cd=1&hl=en&ct=clnk&gl=us.

(56) References Cited

OTHER PUBLICATIONS

Henkel Corporation "Bonderite M-ED 9000 Anodizing Seal (Known as Anoseal 9000)" Technical Process Bulletin Issued Jun. 10, 2013.
Ling Hao and B. Rachel Cheng., "Sealing Processes of Anodic Coatings—Past, Present, and Future", Metal Finishing, vol. 98, Issue 12, Dec. 2000, p. 8-18.
European Patent Application No. 16150283.6—European Search Report dated Jun. 9, 2016.
International Patent Application No. PCT/US2016/043256—International Search Report and Written Opinion dated Oct. 12, 2016.
Diggle et al., Incorporation of anions: "Anodic oxide films on aluminum", Chemical Reviews, vol. 69, pp. 365-405 (1969 ), (41 Pages).
Charles Grubbs, "Anodizing of Aluminium", Metalfinishing, pp. 397-412, (16 Pages).
Milton Stevenson, "Anodizing", ASM Handbook vol. 5 (1994), 12 Pages.
Wang et. al., "Brilliant and tunable color of carbon-coated thin anodic aluminum oxide films", Appl. Phys. Lett., 91, 2007, 4 Pages.
Brock, et al., "European Coatings Handbook", 2000, Curt R. Vincentz, (pp. 374-376), 5 Pages.
Taiwanese Patent Application No. 105125817—Office Action and Search Report dated Apr. 19, 2017.
Achbach et.al. WADC technical report 55-150, Part VI, Project No. 7360, 1957.
Chinese Application for Invention No. 201610011395.4—First Office Action dated Jul. 21, 2017.
Saenz de Miera et. al. Surface and Interface Analysis, 2012 242, 241-246.
John C. Ion. Laser Processing of Engineering Materials. Elsevier, 2005 p. 160.
Chinese Application for Invention No. 201610202013.6—First Office Action dated Sep. 15, 2017.
Chinese Application for Utility Model No. 201490001542.4—First Office Action dated Sep. 27, 2017.
Chinese Patent Application No. 201610011395.4—Second Office Action dated Feb. 14, 2018.
Guo et al., "Analysis of Effect on Hot Crackability of 6060 Alloy Oxide Film", Materials Research and Application, vol. 5, No. 3, P229-232.
European Patent Application No. 16150283.6—Office Action dated Jan. 18, 2018.
Chinese Application for Utility Model No. 201490001542.4—Second Office Action dated Feb. 1, 2018.

* cited by examiner

MICRO-ALLOYING TO MITIGATE THE SLIGHT DISCOLORATION RESULTING FROM ENTRAINED METAL IN ANODIZED ALUMINUM SURFACE FINISHES

CROSS-REFERENCE TO RELATED APPLICATIONS

This application claims the benefit of priority under 35 U.S.C § 119(e) to U.S. Provisional Application No. 62/232,124, entitled "MICRO-ALLOYING TO MITIGATE THE SLIGHT DISCOLORATION RESULTING FROM ENTRAINED METAL IN ANODIZED ALUMINUM SURFACE FINISHES," filed on Sep. 24, 2015, the disclosure of which is incorporated herein by reference in its entirety.

This application is related to U.S. application Ser. No. 14/474,021, entitled "PROCESS TO MITIGATE SPALLATION OF ANODIC OXIDE COATINGS FROM HIGH STRENGTH SUBSTRATE ALLOYS," filed on Aug. 29, 2014; U.S. application Ser. No. 14/593,845, entitled "PROCESSES TO REDUCE INTERFACIAL ENRICHMENT OF ALLOYING ELEMENTS UNDER ANODIC OXIDE FILMS AND IMPROVE ANODIZED APPEARANCE OF HEAT TREATABLE ALLOYS," filed on Jan. 9, 2015; U.S. application Ser. No. 14/678,881, entitled "PROCESS FOR EVALUATION OF DELAMINATION-RESISTANCE OF HARD COATINGS ON METAL SUBSTRATES," filed on Apr. 3, 2015; U.S. application Ser. No. 14/678,868, entitled "PROCESS TO MITIGATE GRAIN TEXTURE DIFFERENTIAL GROWTH RATES IN MIRROR-FINISH ANODIZED ALUMINIUM," filed on Apr. 3, 2015; U.S. application Ser. No. 14/830,699, entitled "PROCESSES TO AVOID ANODIC OXIDE DELAMINATION OF ANODIZED HIGH STRENGTH ALUMINUM ALLOYS," filed on Aug. 19, 2015; and U.S. application Ser. No. 14/830,705, entitled "PROCESSES TO AVOID ANODIC OXIDE DELAMINATION OF ANODIZED HIGH STRENGTH ALUMINUM ALLOYS," filed on Aug. 19, 2015, each of which is incorporated herein in its entirety.

Any publications, patents, and patent applications referred to in the instant specification are herein incorporated by reference in their entireties. To the extent that the publications, patents, or patent applications incorporated by reference contradict the disclosure contained in the instant specification, the instant specification is intended to supersede and/or take precedence over any such contradictory material.

FIELD

The described embodiments relate generally to aluminum alloys and anodized aluminum alloys. More particularly, the present embodiments relate to customized aluminum alloys that reduce or eliminate discoloration of a resultant anodic oxide after anodizing.

BACKGROUND

Anodizing of aluminum is most commonly performed in sulfuric-acid based solutions, for example, using processes defined as "Type II" by U.S. MIL-A-8625 specifications. The resultant anodic oxide coatings generally provide good wear and corrosion resistance to the aluminum substrate. The anodic oxides are also conducive to taking on dyes for coloring. On some aluminum alloys, and within certain process constraints, the resulting anodic oxides from a type II anodizing process may be clear and substantially colorless, giving a bright metallic appearance that is desirable in many products. Thus, type II anodizing is widely used in various industries.

It has been found, however, that using a type II anodizing process on certain types of aluminum alloys can result in anodic oxides that are slightly discolored due to presence of certain types of alloying elements within the aluminum alloys. This slight discoloration may be acceptable for some products where precise coloring is not required. However, in consumer products where finish coloring and color matching of product lines is of utmost importance, such discoloration can be highly undesirable. What is needed therefore are methods of anodizing certain types of aluminum alloys such that discoloration due to alloy elements is minimized or negated.

SUMMARY

This paper describes various embodiments that relate to aluminum alloy compositions designed for producing cosmetically appealing anodic oxide films when they are anodized. In particular, the aluminum alloy compositions include micro-alloying amounts of elements, or combination of elements, that prevent or reduce discoloration of an anodic oxide film when the aluminum alloys is anodized. The aluminum alloys may also include other alloying elements that give the alloys high tensile strength.

According to one embodiment, an enclosure for an electronic device is described. The enclosure includes an aluminum alloy substrate having a non-discoloring element and a micro-alloying element added to a concentration of no greater than about 0.10 weight %. The enclosure also includes an anodic film formed on the aluminum alloy substrate. The micro-alloying element is incorporated within the anodic film and associated with increasing an adhesion strength of the anodic film to the aluminum alloy substrate. The non-discoloring element is incorporated within the anodic film, thereby decreasing discoloration of the anodic film caused by the incorporated micro-alloying element.

According to additional embodiments, a method of anodizing an enclosure for an electronic device is described. The method includes anodizing a high-strength aluminum alloy substrate such that the anodized high-strength aluminum is characterized as having a b* value no greater than 1. The high-strength aluminum alloy substrate has a micro-alloying element and a non-discoloring element. The micro-alloying element is added to a concentration of no greater than about 0.10 weight %. As a result of the anodizing, a portion of the micro-alloying element and a portion of the non-discoloring element are incorporated within a resultant anodic film. An amount of micro-alloying element within the anodic film is associated with an amount of discoloration of the anodic film. The non-discoloring element dilutes the amount of micro-alloying element within the anodic film thereby decreasing the amount of discoloration of the anodic film.

According to further embodiments, an enclosure for an electronic device is described. The enclosure includes an aluminum alloy substrate having no greater than 0.10 weight % of copper and no greater than 0.70 weight % of zirconium. The enclosure also includes an anodic film formed on the aluminum alloy substrate.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
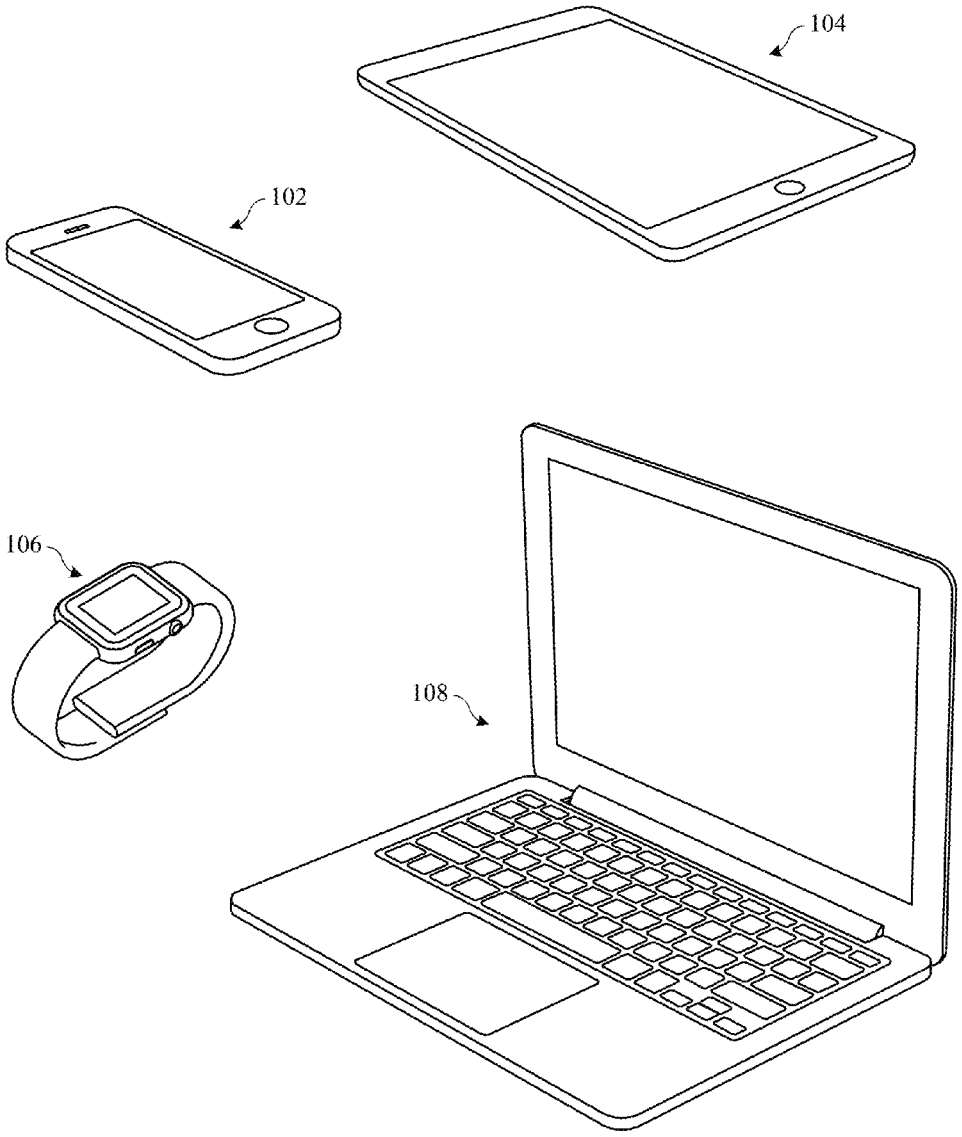
FIG. 1 shows perspective views of devices having metallic surfaces that can be protected using anodic oxide coatings described herein.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

When high strength aluminum alloys, such as commercially available 7000 series aluminum alloys (as defined by the International Alloy Designation System), are anodized using a standard type II anodizing process, the resultant anodized substrate can have a number of issues not observed when anodizing other types of aluminum alloys. One issue is related to the adhesion of the resultant anodic oxide film that is grown on the aluminum alloy substrate. In particular, zinc or other alloying elements from the high strength alloy become enriched at the interface between the anodic oxide film and substrate, which renders the anodic oxide film prone to chipping or spalling.

In previous work presented in U.S. application Ser. Nos. 14/830,699 and 14/830,705, each of which is incorporated herein in its entirety, custom aluminum alloys that include elements such as copper added in micro-alloying amounts can reduce the enrichment of zinc and improve adhesion of the resultant anodic oxide film. It is believed that these micro-alloying elements also enrich at the interface and thereby reduce or prevent the enrichment of zinc. However, such micro-alloying elements, even in such trace amounts, have been found to discolor the anodic oxide film—typically adding a slightly yellow hue to the anodic oxide film. If specifications for amounts of discoloration are very tight, even this slight discoloration can be unacceptable.

To address this discoloration problem, the present work describes adding yet another class of element(s) in micro alloying amounts to the aluminum alloy that serves to reduce or eliminate the discoloration. These further alloying element additions are believe to also be interfacially enriched during anodizing. However, unlike copper, manganese and iron micro-alloying elements, these further micro-alloying elements do not measurably discolor the resulting oxide, but instead are believed to dilute the discoloration of the coloring micro-alloying elements. The resulting anodic oxides are relatively colorless and substantially clear.

The present paper makes specific reference to aluminum alloys and aluminum oxide coatings, and particularly to 7000-series alloys of aluminum, which comprise zinc-based strengthening precipitates. It should be understood, however, that the methods described herein may be applicable to other types of aluminum alloys—such as 8000-series, which contain lithium and zinc alloying elements—and possibly also to any of a number of other suitable anodizable metal alloys, such as suitable alloys of titanium, zinc, magnesium, niobium, zirconium, hafnium, and tantalum, or suitable combinations thereof. As used herein, the terms anodic oxide, anodic oxide coating, anodic film, anodic layer, anodic coating, oxide film, oxide layer, oxide coating, etc. can be used interchangeably and can refer to suitable metal oxide materials, unless otherwise specified.

Methods described herein are well suited for providing cosmetically appealing surface finishes to consumer products. For example, the methods described herein can be used to form durable and cosmetically appealing anodized finishes for housing for computers, portable electronic devices, wearable electronic devices, and electronic device accessories, such as those manufactured by Apple Inc., based in Cupertino, Calif.

These and other embodiments are discussed below with reference to FIGS. 1-7. However, those skilled in the art will readily appreciate that the detailed description given herein with respect to these Figures is for explanatory purposes only and should not be construed as limiting.

The methods described herein can be used to form durable and cosmetically appealing coatings for metallic surfaces of consumer devices. FIG. 1 shows consumer products than can be manufactured using methods described herein. FIG. 1 includes portable phone 102, tablet computer 104, smart watch 106 and portable computer 108, which can each include housings that are made of metal or have metal sections. Aluminum alloys are often a choice metal material due to their light weight and ability to anodize and form a protective anodic oxide coating that protects the metal surfaces from scratches. The anodic oxide coatings can be dyed to colorize the metal housing or metal sections, adding numerous cosmetic options for product lines.

Devices 102, 104, 106 and 108 can be subject to drop events that can bend or otherwise deform the housings unless the housings are made of durable and bend resistant materials. Certain high strength aluminum alloys, such as some 7000 series aluminum alloys, are designed for high tensile strength and can resist bending and deformation. However, some of these high strength aluminum alloys will take on a discolored finish when anodized. This can be due to the presence of alloying elements within the aluminum alloy that can become entrained within a resultant anodic oxide coating during the anodizing process. Often the discoloration is characterized as a yellow hue, which is counter to an aesthetically desirable bright silver color.

Described herein are aluminum alloy compositions that have high tensile strength and that can form substantially colorless anodic oxide films when anodized. As such, these aluminum alloy compositions are well suited for forming durable and cosmetically appealing housing for devices 102, 104, 106 and 108, as well as other consumer products.

The color of anodized aluminum samples can be characterized using a CIE 1976 L*a*b* color space model measurement. In general, the L*a*b* color space model is used to characterize colors of an object according to color opponents L* corresponding to an amount of lightness, a* corresponding to amounts of green and magenta, and b* corresponding to amounts of blue and yellow. By convention, higher L* values correspond to greater amounts of lightness and lower L* values correspond to lesser amounts of lightness. Negative a* values indicate a green color, with more negative a* values indicating a greener color, and positive a* values indicate a red color, with more positive a* values indicating a redder color. Negative b* values indicate a blue color, with more negative b* values indicating a bluer color, and positive b* values indicate a yellow color, with more positive b* values indicating a yellower color.

High strength aluminum alloys include a number of alloying elements that give the alloys their high strength. These elements generally include zinc and magnesium since these elements can combine to form precipitates (e.g., $MgZn_2$ η' precipitates) that give these alloys their high tensile strength. Anodizing of aluminum alloys where alloying has been restricted to certain "colorless" alloying elements such as magnesium and zinc, can, under certain conditions, yield a colorless and clear anodic oxide film. Ideal anodizing conditions for such alloys are those categorized as "Type II" anodizing by U.S. military specification MIL-A-8625. These include, for instance, anodizing at 1.5 Amps per square decimeter (ASD) and 20° C. in 200 g/L sulfuric acid. The colorless surface finish will have a* and b* color coordinates of less than 1, and preferably less than 0.5, indicating that it has no perceptible red/green or yellow/blue hue. In some products, this bright metallic, "silver" finish is considered a desirable anodized surface finish.

Few alloying elements may be added to an aluminum alloy without resulting in discoloration of the anodized surface finish. The aforementioned magnesium and zinc are examples of permissible alloying additions, as can be lithium. Others, such as silicon, may only be tolerated up to about 1% before the anodic film starts to darken, resulting in a reduced L* color parameter, or reduced gloss and optical clarity of the anodic film. Copper, manganese, iron, silver and many other elements result in discoloration, most typically resulting in an anodic film with a yellow hue (positive b*) and or red hue (positive a*).

Figure 2:
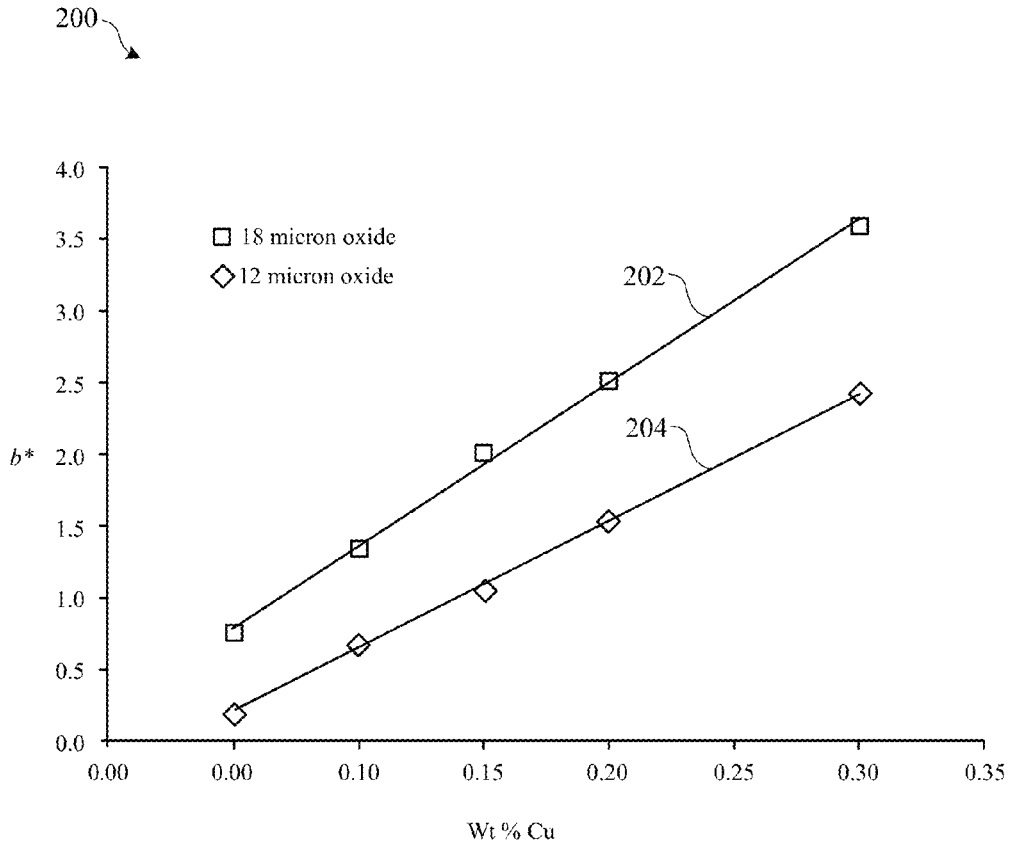
FIG. 2 shows a graph indicating color effects of copper on anodized aluminum alloy samples.

To illustrate, FIG. 2 shows graph 200 indicating color effects of copper on anodized aluminum alloy samples. Graph 200 indicates relative amounts of discoloration for different anodized aluminum alloys samples as characterized by b* values in accordance with the CIE L*a*b* color space model (using a D65 "white" illuminant), with more positive b* corresponding to samples having yellow colors.

As described above, zinc and magnesium can form precipitates that strengthen an aluminum alloy. Aluminum alloys with only zinc and magnesium as alloying elements (referred to herein as "pure Al—Zn—Mg alloys") do not produce anodic oxide films with any significant yellowing. If a pure Al—Zn—Mg alloy has a balanced proportion of magnesium and zinc (e.g., atomic % zinc=2 times atomic % magnesium to yield $MgZn_2$ η' precipitates), the composition can be referred to as "balanced."

Graph 200 shows b* values for non-dyed anodized balanced pure Al—Zn—Mg alloys aluminum samples with different amounts of copper additions. Line 202 corresponds to a best-fit line for data collected on samples with anodic oxide films each having a thickness of about 18 micrometers, and line 204 corresponds to a best-fit line for data collected on samples with anodic oxide films each having a thickness of about 12 micrometers. As shown, the yellow discoloration of the aluminum alloys is approximately linearly related to an amount of copper within a substrate sample. For non-dyed anodic oxide films on a silver colored substrate, people are generally easily able to detect color differences between samples having b* values that differ by about 0.5. Thus, a sample having 0.30 weight % of copper would be very noticeably more yellow than a sample having 0.05 weight % of copper.

In addition, graph 200 indicates that the color intensity of an anodic film is an approximately linear function of anodic film thickness. That is, when thicker coatings are grown, the discoloration is correspondingly more severe. Thus, the samples having a thickness of about 18 micrometers (line 202) has more positive b* values compared to the samples having a thickness of about 12 micrometers (line 204). This is also true for other alloys such as 6013 aluminum alloy, which generally cannot be anodized to more than a few micrometers of thickness without being well outside tolerances for a "colorless" anodic oxide finish. This thickness constraint may be unacceptable where the anodic oxide is required to be thicker for wear or corrosion protection.

Although the mechanism for this discoloration is not fully understood, elements such as copper, manganese, iron and silver are known to enrich at the interface during anodizing, primarily due to their relatively positive Gibbs free energy for oxide formation, as compared with that of the aluminum of the metal alloy matrix. This interfacial enrichment is described in detail in U.S. application Ser. Nos. 14/830,699 and 14/830,705. The enrichment is generally localized within a layer of just 2-3 nanometers of thickness at the interface between the anodic oxide and the substrate metal. However, the amount of enrichment can be very high—some estimates are of the order of 50 atomic %.

In the previous work presented in U.S. application Ser. Nos. 14/830,699 and 14/830,705, it has been shown that micro-alloying with elements such as copper even in trace amounts such as 0.05 weight % is a valuable alloying addition to certain alloys, notably to an otherwise pure Al—Zn—Mg aluminum alloy. In the absence of copper, a pure Al—Zn—Mg alloy is vulnerable to interfacial accumulation of zinc and to corresponding interfacial weakness, especially when anodized in sulfur-based electrolytes. As little as 0.05 weight % copper is sufficient to overcome this problem and gives minimal discoloration—i.e., b* values less than 1 (see FIG. 2). The addition of copper also helps overcome anodizing defects corresponding to preferential growth rates of grains of {111} surface orientation. Thus, there are benefits to adding micro-alloying amounts of copper despite some discoloring effects. However, even this minimal coloration can nevertheless be undesirable in seeking optimal aesthetics.

Figure 3:
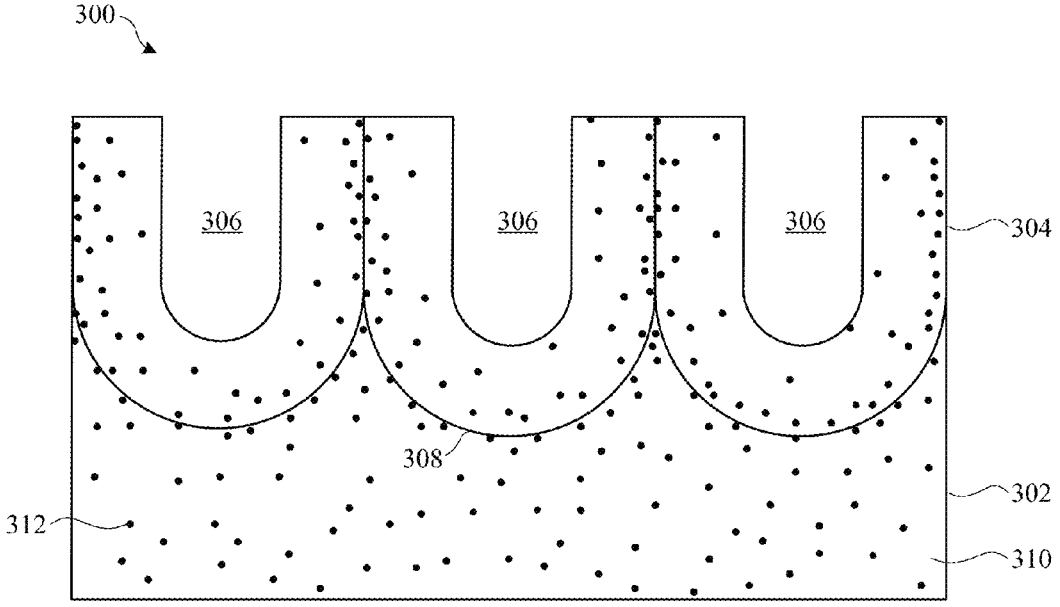
FIG. 3 shows a schematic cross-section view of a portion of a part, showing how alloying elements, such as copper, can become incorporated within an anodic oxide film.

It is postulated that discoloring elements, such as copper, enrich at the interface between the anodic film and metal substrate and become entrained into the anodic oxide as metallic inclusions between anodic pores of the anodic oxide. To illustrate FIG. 3 shows a schematic cross-section view of a portion of part 300, which includes aluminum alloy substrate 302 after an anodizing process whereby a portion of substrate 302 is converted to anodic oxide film 304. Anodic oxide film 304 includes anodic pores 306, which correspond to vertically elongated voids formed during the anodizing process. The region between anodic oxide film 304 and substrate 302 can be referred to as interface 308.

Substrate 302 includes aluminum matrix 310, which includes discoloring element 312 dispersed therein. Discoloring element 312 can be, for example, copper, manganese, iron and/or silver. Discoloring element 312 is added in micro-alloying amounts to counteract problems associated with zinc (not shown) and preferential oxide growth rates, as described above. Despite the benefits of using discoloring element 312, discoloring element 312 can become enrich at interface 308 and in regions between pores 306 during the anodizing process, and thereby become entrained within anodic oxide film 304. Once incorporated within anodic oxide film 304, discoloring element 312 can cause anodic oxide film 304 to be discolored. In some cases only traces of discoloring element 312 can have significant effects on the perceived color of anodic oxide film 304. The color and magnitude of the discoloration will depend on the type of discoloring element 312, the amount of discoloring element 312 (see FIG. 2), and the thickness of anodic oxide film 304 (see FIG. 2). Note that it may be possible to reduce the amount of discoloration by adjusting anodizing parameters, such as by anodizing more slowly, at a lower current density, or using a higher anodizing bath temperature—however these adjustments will generally result in a softer anodic oxide film that is not sufficiently hard for many consumer product applications.

Figure 4:
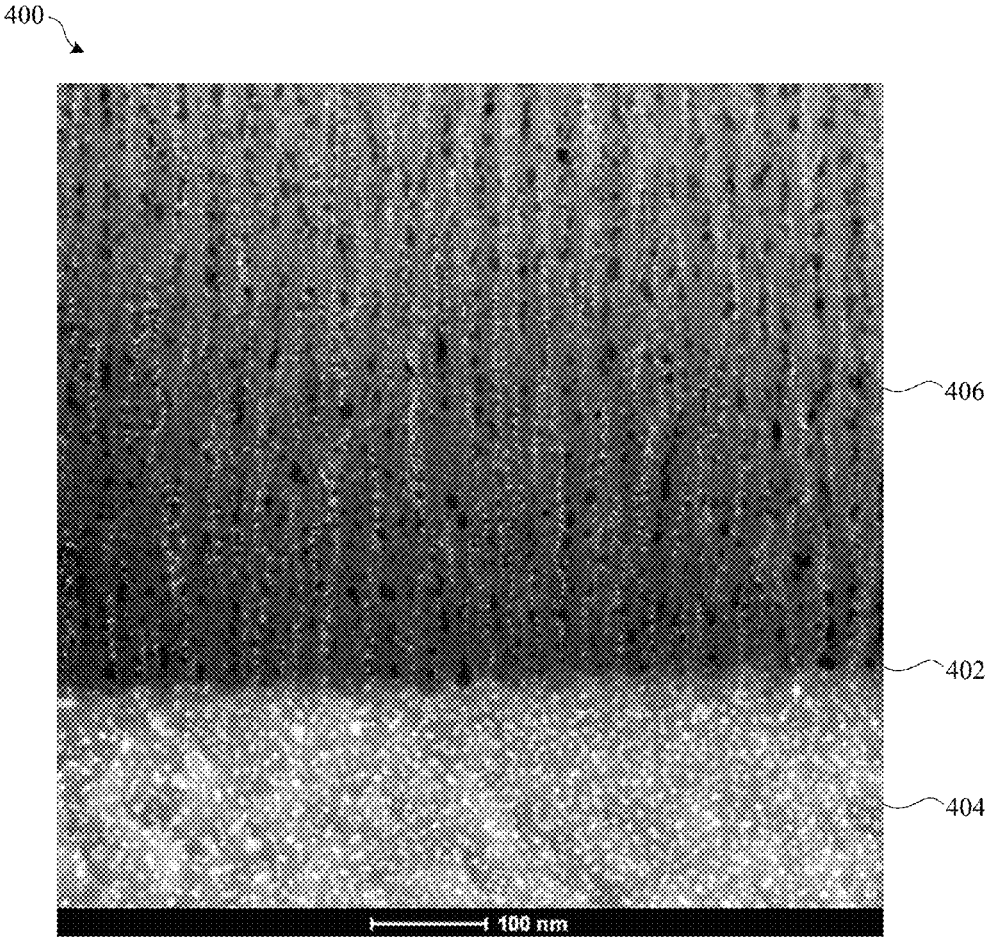
FIG. 4 shows a transition electron microscope (TEM) image of a cross-section of an anodized aluminum alloy substrate with micro-alloying amounts of copper.

This entrainment interpretation is supported by FIG. 4, which shows a dark field transition electron microscope (TEM) image 400 of a cross-section of an anodized Al—Zn—Mg aluminum alloy substrate with copper added in micro-alloying amounts. TEM image 400 show a close-up view of interface 402 between substrate 404 and anodic oxide film 406. Anodic oxide film 406 includes vertically oriented anodic pores, as is typical of anodic oxide films. However, anodic oxide film 406 also includes strings of light-colored material between the anodic pores. It is believed that these light-colored strings correspond to metallic inclusions from entrained copper, and is presumed to be the cause of discoloration.

Another observation is that when discolored anodic films are progressively polished back, the discoloration falls in approximately linear proportion to the removed thickness of oxide, indicating that the discoloration is fairly uniformly distributed through the anodic film thickness.

It is an aim of embodiments described herein to widen the allowable composition range of aluminum alloys particularly with regard to minor alloying element additions (i.e., about 0.05 weight %) that have such discoloring effects, whilst retaining the cosmetics of a purer aluminum alloy. In particular, minor amounts of additional elements are added to the aluminum substrates that change the composition of the entrained metal, thereby offsetting the discoloration.

Figure 5:
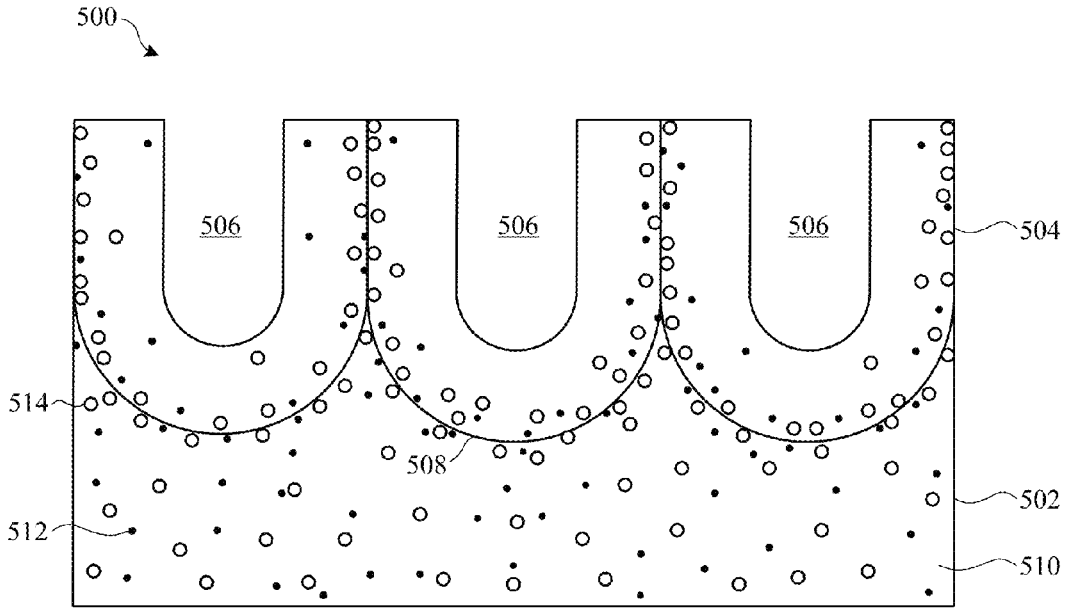
FIG. 5 shows a schematic cross-section view of a portion of a part, showing how addition of a non-discoloring element can counteract the discoloring effects of some alloying elements.

FIG. 5 illustrates a schematic cross-section view of a portion of anodized part 500 after the addition of non-discoloring element 514. Part 500 includes aluminum alloy substrate 502 with a portion converted to anodic oxide film 504, which includes anodic pores 506. Substrate 502 has discoloring element 512 (e.g., copper, manganese, iron and silver), which becomes enriched at interface 508 and between anodic pores 506 during the anodizing process, and thereby becomes incorporated within anodic oxide film 504. However, the addition of non-discoloring element 514 to substrate 502 causes non-discoloring element 514 to also enrich at interface 508 and between pores 506, thereby also becoming incorporated within anodic oxide film 504 along with discoloring element 512. In this way, it is believed that non-discoloring element 514 replaces some of the enriched discoloring element 512—in effect, diluting the amount of discoloring element 512 within anodic film 504 and diluting the amount of discoloration caused by discoloring element 512. Since it is possible for only traces of discoloring element 512 to significantly affect the color of anodic oxide film 504, even slightly reducing the amount of discoloring element 512 within anodic oxide film 504 can have large affects on the perceived color of anodic oxide film 504.

Additional or alternative mechanisms that may be occurring is that non-discoloring element 514 within anodic oxide film 504 may be reflecting different wavelengths of light than those of discoloring element 512, thereby cancelling out or attenuating the discoloration caused by discoloring element 512. For example, zirconium non-discoloring element 514 may cause anodic oxide film 504 to reflect a bluish hue that counteracts a yellowish hue caused by copper discoloring element 512, resulting in a more color-neutral appearance.

Like discoloring element 512, non-discoloring element 514 should become entrained within anodic film 504 during the anodizing process. Thus, non-discoloring element 514 should have a more positive Gibbs free energy for oxide formation as compared with that of the aluminum 510. However, unlike discoloring element 512, non-discoloring element 514 should not discolor anodic oxide film 504. In some cases, this means that non-discoloring element 514 offers no inherent discoloration of anodic oxide film 504. In other cases, non-discoloring element 514 offers a color hue that neutralizes that of discoloring element 512 (e.g., blue hue that neutralizes a yellow hue).

Possible candidates for non-discoloring element 514 can include zirconium, titanium, hafnium, vanadium, niobium, tantalum, molybdenum and tungsten. In some embodiments, non-discoloring element 514 includes a combination of two or more of zirconium, titanium, hafnium, vanadium, niobium, tantalum, molybdenum and tungsten. In some embodiments where discoloring element 512 includes copper, zirconium non-discoloring element 514 is found to provide good reduction of discoloration caused by the copper.

The concentration of non-discoloring element 514 added to substrate 502 should be relatively low but can vary depending, in part, on the concentration of discoloring element 512 added to substrate 502. In particular embodiments, additions of about 0.05 weight % of zirconium or titanium non-discoloring element 514 are added to alloys comprising about 0.05 weight % of copper, silver or manganese discoloring alloying element 512 to offset some of the discoloration. Similar concentrations may produce similar effects using hafnium, vanadium, niobium, tantalum, molybdenum or tungsten non-discoloring element 514. The 0.05 weight % limit may be preferred in some embodiments primarily due to the specifications of commercial 7000 series alloys, which state a maximum level of 0.05 weight % for "any other" element. This is thus a consideration if the present alloys are to be readily accepted into recycling streams.

In addition, solubility limits of the non-discoloring element 514 within substrate 502 should be considered. For example, concentrations of zirconium non-discoloring element 514 above 0.10 weight % may cause visible defects associated with adding zirconium above solubility limits. It should be noted that types of non-discoloring elements 514 having lower atomic mass have correspondingly higher atomic concentrations for a given concentration by weight—and thus the lighter elements may be more efficient at diluting the effects of discoloring element 512.

Figure 6:
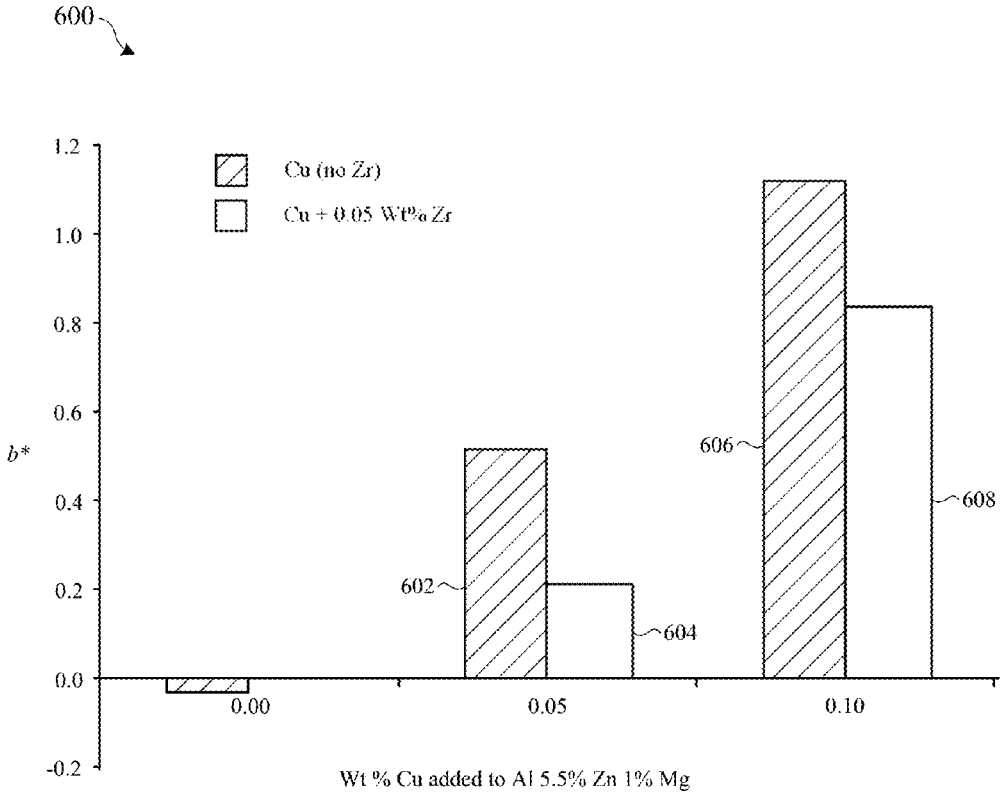
FIG. 6 shows a bar graph indicating color effects of using zirconium to counter the discoloring effects of copper on anodized aluminum alloy samples.

FIG. 6 shows bar graph 600 indicating color effects of using micro-alloying amounts of zirconium to counter the discoloring effects of micro-alloying amounts of copper on anodized aluminum alloy samples. All samples are non-dyed anodized balanced pure Al—Zn—Mg alloy samples with copper additions, or copper and zirconium additions. Each sample has an anodic film thickness of about 18 micrometers. Bar graph 600 shows that those samples where zirconium was added in addition to copper, the zirconium reduces the amount of discoloration as indicated by measured b* values. For instance, sample 602 that includes 0.05 weight % copper without zirconium has a b* value of over 0.5, whereas sample 604 that includes 0.05 weight % copper and 0.05 weight % zirconium has a b* value of about 0.2. Similarly, sample 606 that includes 0.10 weight % copper without zirconium has a b* value of nearly 1.2, whereas sample 608 that includes 0.10 weight % copper and 0.05 weight % zirconium has a b* value of less than 0.9.

Bar graph 600 indicates that in those applications where the target b* value is less than 1.0, copper can be added by a concentration of 0.10 weight % as long as zirconium is added to at least a concentration of 0.05 weight %. In those applications where the target b* value is 0.2 or less, copper can be added by a concentration of 0.05 weight % as long as zirconium is added to at least a concentration of 0.05 weight %. Thus, the addition of zirconium widens the allowable concentrations of copper without having unacceptable discoloring effects. That is, the dilution effects of zirconium may allow for increased amounts of copper while remaining at or below a predetermined amount of acceptable discoloration (e.g., b* less than 1). For example, by adding 0.05 weight % of zirconium to a substrate, it may be possible to increase the amount of copper to 0.10 weight % while still retaining a b* value of less than 1 for the resultant anodic film. Increasing the amount of copper has an advantage of increasing adhesion strength of the anodic film to the substrate and also reducing defects related to different anodic film growth rates at certain grain orientations of the substrate. Likewise, a thicker anodic oxide film can be grown while remaining below at or below the predetermined amount of acceptable discoloration. For instance, the dilution effects of zirconium can make is possible to increase a thickness of an anodic film from 12 micrometers to 18 micrometers, or more, without exceeding acceptable levels of discoloration.

It should be noted that although adding more zirconium can further reduce the discoloring effects of copper, adding too much zirconium could have deleterious effects. Zirconium levels at and above the solubility limit (about 0.07 weight %) result in the formation of $Al_3Zr$ precipitate. This precipitate can inhibit recrystallization and restrict grain growth during hot-work based processes. The ensuing microstructure within the aluminum substrate is streaky and unsuitable for many cosmetic applications. Moreover, keeping the concentration of zirconium to a level of 0.05 weight % or less keeps the concentration at or below the 0.05 weight % maximum for "any other" element dictated by recycling streams for commercial alloys.

Figure 7:
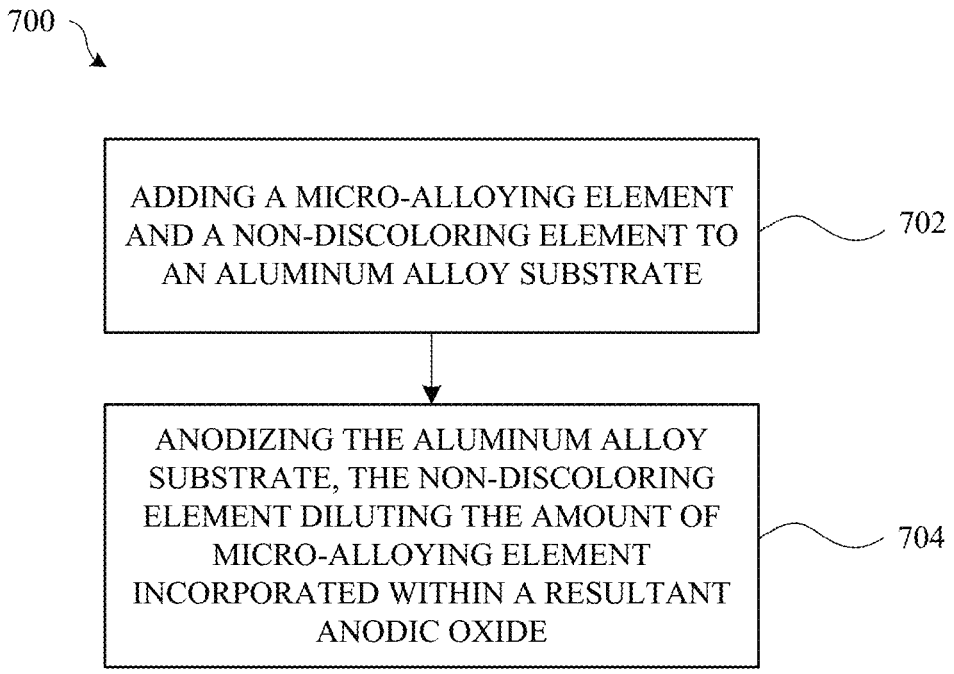
FIG. 7 shows a flowchart indicating a process for anodizing a high-strength aluminum alloy substrate such that the anodized substrate has minimal discoloration.

FIG. 7 shows flowchart 700 indicating a process for anodizing a high-strength aluminum alloy substrate such that the anodized substrate has minimal discoloration as well as good anodic film adhesion. At 702, a micro-alloying element and a non-discoloring element are added to the aluminum alloy substrate. In some embodiments, the micro-alloying element includes at least one of copper, manganese, iron and silver. The micro-alloying element should be added to small concentrations, for example concentrations no greater than about 0.10 weight %. In some embodiments, the non-discoloring element includes at least one of zirconium, tantalum, molybdenum, hafnium, tungsten, vanadium, niobium and tantalum. The non-discoloring element should also be added in small concentrations, for example concentrations no greater than about 0.10 weight % —in some preferred embodiments no greater than about 0.05 weight %.

The aluminum alloy substrate can also include other alloying elements, such as zinc and/or magnesium. Zinc and magnesium can form precipitates that provide tensile strength to the high-strength aluminum alloy. In some embodiments, a balanced proportion of magnesium and zinc to yield $MgZn_2$ η' precipitates. In a particular embodiment, the aluminum alloy substrate includes about 5.5 weight % zinc and about 1.0 weight % magnesium.

At 704, the aluminum alloy substrate is anodized. The parameters of the anodizing process (e.g., current density, anodizing electrolyte composition, and anodizing electrolyte temperature) can be chosen to result in an anodic film having at least a predetermined hardness. In particular embodiments, a Type II anodizing process is used, such as using 1.5 ASD with a 20° C. in 200 g/L sulfuric acid anodizing electrolyte.

During the anodizing, the micro-alloying element and the non-discoloring element become enriched at the interface between the substrate and the anodic film, thereby becoming entrained within the anodic film. The enriched micro-alloying element at the interface can increase the adhesion strength of the anodic film to the substrate. In particular, the micro-alloying element reduces enrichment of zinc at the interface, which is associated with weakening the adhesion strength of the anodic film. However, the micro-alloying element entrained within the anodic film can discolor the anodic film. The non-discoloring element acts by diluting the relative amount of the micro-alloying element enriched at the interface, and entrained within the anodic film, thereby reducing the discoloring effects of the micro-alloying element. In some cases, the relative amounts of micro-alloying element and non-discoloring element are chosen in order to accomplish anodized substrate having discoloration below maximum predetermined amount as measured using a CIE L*a*b* color space model. In a particular embodiment, the anodized high-strength aluminum is characterized as having a b* value no greater than 1, as measure by CIE 1976 L*a*b* color space model measurement using a D65 white illuminant. In some preferred embodiments, the b* value is no greater than 0.6. In some embodiments, the b* value is no greater than 0.2.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed is:

1. An enclosure for an electronic device, the enclosure comprising:

an aluminum alloy substrate having (i) a non-discoloring element, and (ii) a micro-alloying element that is included in a concentration of a non-zero amount no greater than 0.10 weight %, or a concentration of about 0.10 weight %, of the aluminum alloy substrate; and an anodic film formed on the aluminum alloy substrate, wherein the micro-alloying element is incorporated within the anodic film and associated with discoloration of the anodic film, and the non-discoloring element is incorporated within the anodic film, thereby decreasing an amount of discoloration of the anodic film caused by the micro-alloying element.

2. The enclosure of claim 1, wherein the micro-alloying element includes at least one of copper, manganese, iron or silver.

3. The enclosure of claim 1, wherein decreasing the amount of discoloration of the anodic film caused by the micro-alloying element is associated with increasing an adhesion strength of the anodic film to the aluminum alloy substrate.

4. The enclosure of claim 1, wherein the non-discoloring element includes at least one of zirconium, tantalum, molybdenum, hafnium, tungsten, vanadium, niobium or tantalum.

5. The enclosure of claim 1, wherein the non-discoloring element is zirconium.

6. The enclosure of claim 4, wherein a concentration of the zirconium within the aluminum alloy substrate is included in a concentration of a non-zero amount no greater than 0.10 weight %, or a concentration of about 0.10 weight %, of the aluminum alloy substrate.

7. The enclosure of claim 1, wherein the aluminum alloy substrate further comprises zinc and magnesium.

8. The enclosure of claim 7, wherein a concentration of the zinc is about 5.5 weight % and a concentration of the magnesium is about 1.0 weight % of the aluminum alloy substrate.

9. The enclosure of claim 1, wherein the anodic film has a b* value of no greater than 1, as measure by CIE 1976 L*a*b* color space model measurement using a D65 white illuminant.

10. A method of forming an enclosure for an electronic device, the method comprising:

forming an anodic layer on an aluminum alloy substrate by anodizing a portion of the aluminum alloy substrate, wherein the aluminum alloy substrate includes (i) a non-discoloring element, and (ii) a micro-alloying element that is associated with discoloration of the anodic layer and is included in a concentration of a non-zero amount no greater than 0.10 weight %, or a concentration of about 0.10 weight %, of the aluminum alloy substrate, wherein the anodic layer includes the micro-alloying element and the non-discoloring element, and the non-discoloring element minimizes an amount of discoloration of the anodic layer caused by the micro-alloying element.

11. The method of claim 10, wherein the anodic layer has a thickness of at least 12 micrometers or greater.

12. The method of claim 11, wherein the anodic layer is characterized as having a b* value that is no greater than 1, as measured by CIE 1976 L*a*b* color space model measurement using a D65 white illuminant.

13. The method of claim 10, wherein the micro-alloying element includes at least one of copper, manganese, iron or silver.

14. The method of claim 10, wherein the non-discoloring element includes at least one of zirconium, tantalum, molybdenum, hafnium, tungsten, vanadium, niobium or tantalum.

15. A metal part for an electronic device, comprising:

an aluminum alloy substrate including (i) a micro-alloying element that is included in a concentration of a non-zero amount no greater than 0.10 weight %, or a concentration of about 0.10 weight %, of the aluminum alloy substrate, and (ii) a non-discoloring element; and an anodic layer formed on the aluminum alloy substrate, wherein the anodic layer includes (i) an amount of the non-discoloring element, and (ii) an amount of the micro-alloying element that is capable of causing discoloration of the anodic layer, wherein the amount of the non-discoloring element is sufficient to minimize the discoloration of the anodic layer caused by the amount of the micro-alloying element such that the anodic layer has a b* value of no greater than 1, as measured by CIE 1976L*a*b* color space model measurement using a D65 white illuminant.

16. The metal part of claim 15, wherein the non-discoloring element includes at least one of zirconium, tantalum, molybdenum, hafnium, tungsten, vanadium, niobium or tantalum.

17. The metal part of claim 16, wherein the micro-alloying element includes at least one of copper, manganese, iron or silver.

18. The metal part of claim 15, wherein the micro-alloying element is copper, and the non-discoloring element is zirconium.

19. The metal part of claim 15, wherein the aluminum alloy substrate includes about 5.5 weight % zinc and about 1.0 weight % magnesium.

20. The metal part of claim 15, wherein the anodic layer has a thickness of at least 10 micrometers or greater.

* * * * *